US005354581A

United States Patent [19]

Laube

[11] Patent Number: 5,354,581

[45] Date of Patent: Oct. 11, 1994

[54] SURFACE TREATMENT OF SHEET- OR PLATE-LIKE BLANKS

[75] Inventor: Hans-Jürgen Laube, Siegershausen, Switzerland

[73] Assignee: HJL Projects & Developments Ltd., Dudingen, Switzerland

[21] Appl. No.: 638,094

[22] Filed: Jan. 7, 1991

[30] Foreign Application Priority Data

Jan. 17, 1990 [CH] Switzerland ..... 00148/90-6
Nov. 28, 1990 [CH] Switzerland ..... 03768/90-7

[51] Int. Cl.[5] ..... B05D 3/00; B05D 3/12

[52] U.S. Cl. ..... 427/299; 72/187; 72/197; 72/198; 427/322; 427/327; 451/55; 451/59

[58] Field of Search ..... 427/299, 322–330; 51/290, 324, 326, 328; 72/187, 197, 198

[56] References Cited

U.S. PATENT DOCUMENTS

| | | | |
|---|---|---|---|
| 2,335,196 | 9/1940 | Pecsok | 29/81 |
| 2,831,521 | 4/1958 | Collins | 72/187 X |
| 2,907,151 | 10/1959 | Peterson | 51/281 |
| 3,082,517 | 3/1963 | Holowaty | 29/424 |
| 4,092,842 | 6/1978 | Oser et al. | 72/187 X |
| 4,338,807 | 7/1982 | Ricono et al. | 72/187 |
| 4,747,991 | 5/1988 | Bishop | 264/284 X |
| 4,909,894 | 3/1990 | Uesugi et al. | 51/326 X |

FOREIGN PATENT DOCUMENTS

| | | |
|---|---|---|
| 2252175 | 6/1975 | France . |
| 495421 | 11/1938 | United Kingdom . |

*Primary Examiner*—Michael Lusignan
*Attorney, Agent, or Firm*—Darby & Darby

[57] ABSTRACT

One side of a sheet- or plate-like bank of metallic, plastic and/or other material is provided with at least one set of parallel grooves prior to being provided with an array of pyramidal and/or conical depressions. The grooves can be formed by brushes or by grinding, and the depressions can be formed by a rotary debossing tool having a peripheral surface provided with crossing transversely extending rows and circumferentially extending columns of protuberances. The treatment enhances the ability of the one side of the thus obtained sheet- or plate-like body to accept and retain a layer of lacquer, to be provided with an adherent layer of oxide or to accept a layer of adhesive prior to being bonded to a similarly treated or to an untreated second plate- or sheet-like body. The depth of the depressions can match or approximate the average depth of the grooves. The grooves can form two sets of parallel grooves, and the grooves of one set can cross the grooves of each other set at an angle of 90±45.

21 Claims, 3 Drawing Sheets

FIG. 5
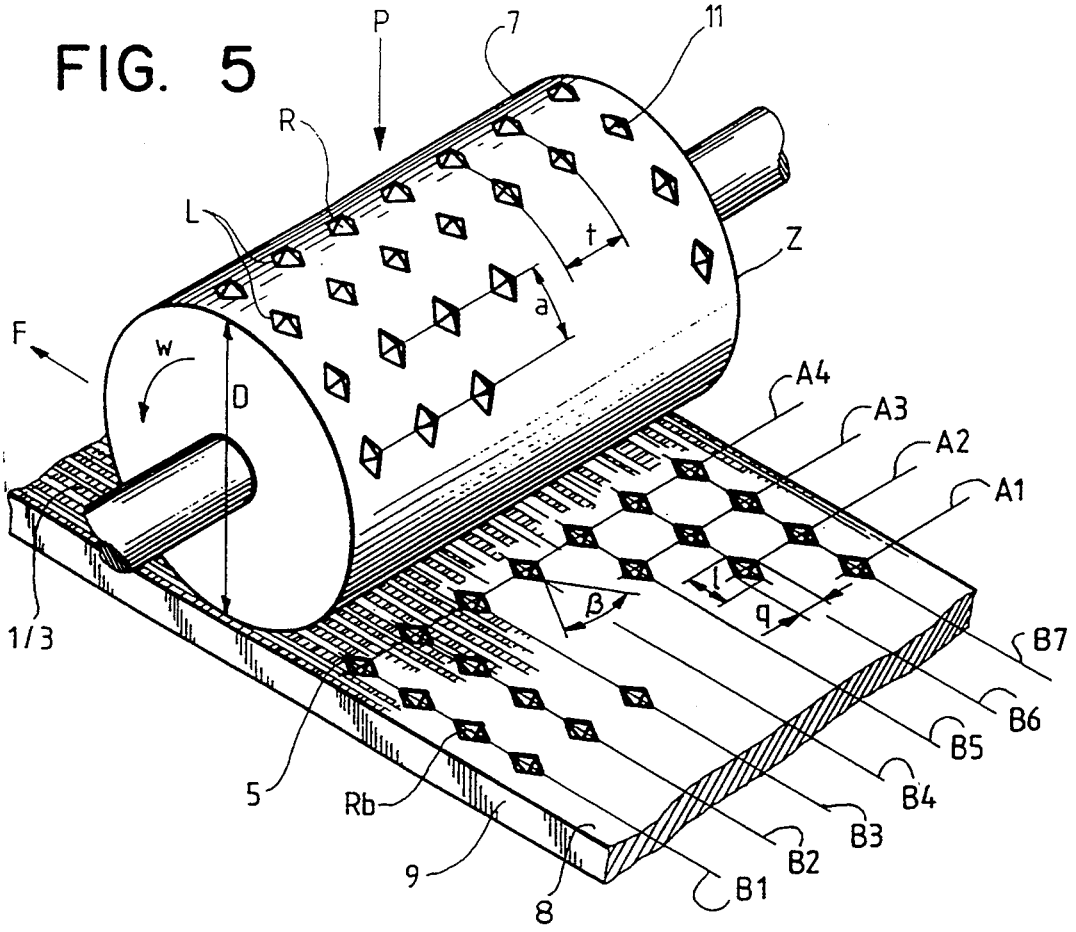
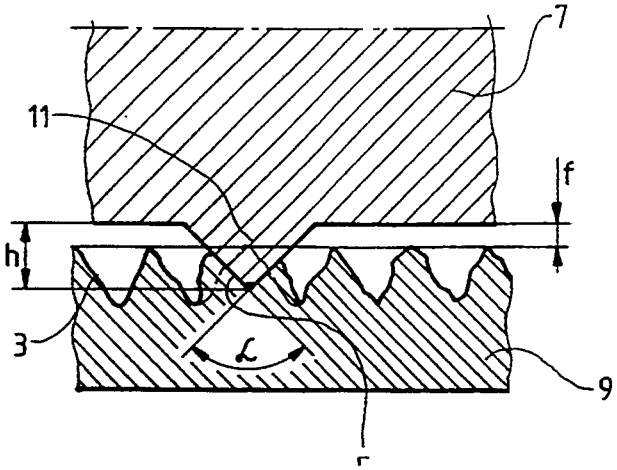
FIG. 6

SURFACE TREATMENT OF SHEET- OR PLATE-LIKE BLANKS

BACKGROUND OF THE INVENTION

The invention relates to surface treatment of panel-, plate- or sheet-like blanks which are made of a metallic, plastic and/or other material. More particularly, the invention relates to improvements in methods of mechanically surface beneficiating panel-, sheet- or plate-like blanks (hereinafter called blanks for short) and to panel-, plate- or sheet-like bodies which constitute the treated or converted blanks.

It is often necessary to provide a panel-, plate- or sheet-like body with one or more layers of paint, lacquer and/or other material. Such layers are applied to enhance the appearance of the body and/or to reduce the likelihood of corrosion. It is also known to artificially or intentionally oxidize the surfaces of panel-, plate- or sheet-like bodies, especially of bodies which consist of or contain aluminum. Still further, it is known to bond or plate one side or surface of a first panel-, plate- or sheet-like body to one side of a second panel-, plate- or sheet-like body in order to protect the first and/or the second body from corrosion and/or other undesirable influences or to enhance the appearance, strength and/or other desirable characteristics of the first and/or second body.

The sides or surfaces of a panel-, plate- or sheet-like blank, particularly a rolled metallic blank, are often coated with films of grease or other lubricating material which is applied by rolls or by other component parts of rolling mills or other machines or production lines wherein the blank is made or treated. Such films interfere with predictable application of layers of lacquer, paint and/or other coating materials. Moreover, the films often interfere with predictable artificial oxidation of one or both sides or surfaces of a rolled blank, either in air or in a vessel wherein the blank is caused to react with an oxidation-promoting liquid substance.

Attempts to remove the films of grease and/or other lubricants include a preliminary treatment of blanks with suitable solvents. A drawback of such procedure is that the preliminary treatment of blanks takes up a substantial amount of time. In addition, care must be taken to gather all volatile ingredients of the solvent as well as to dispose of the removed lubricant in an ecologically acceptable manner.

It was already proposed to enhance the ability of exposed surfaces of metallic, plastic and/or other blanks to reliably retain layers of lacquer, paint or the like by sandblasting and/or by an analogous treatment, e.g., with minute particles of glass or metal (such as steel). Sandblasting or an analogous treatment can accomplish two objects, namely that of removing the film of lubricant as well as that of roughening the treated surface or surfaces to ensure more predictable and stronger adherence to layers of paint or the like. As a rule, sandblasting or a similar treatment is resorted to in connection with the surface treatment of metallic sheets having a thickness of up to 2 mm. However, it has been found that intensive sandblasting or a similar treatment (such as is necessary to reliably remove the film or films of lubricant and to adequately roughen the treated surface or surfaces) often results in undesirable localized densification of the material of the treated blank. Such densification causes buckling and/or other deformations as well as undesirable hardening of densified portions of the material of the thus treated blank. This is often undesirable or plain unacceptable, either because it affects the appearance of the treated body and/or because it entails unpredictable changes of characteristics such as can prevent further treatment of the body in a desired manner. For example, a sheet which has been treated by sandblasting or was subjected to an analogous treatment is likely to develop cracks as a result of subsequent folding, bevelling, canting or other profiling.

In accordance with another prior proposal, films of lubricant are removed by subjecting the surface or surfaces of blanks to the action of rotary brushes or grinding tools. The brushes or grinding tools roughen the surfaces of the blanks to render them more receptive for layers of lacquer or the like. It has been found that such treatment can greatly enhance the ability of the surfaces of metallic panels, sheets or plates to accept and retain layers or coats of paint or the like as well as to undergo predictable artificial oxidation, either in the atmosphere or as a result of contact with a liquid oxidant in a vessel or the like. However, the just discussed treatment also brings about certain drawbacks which reduce its utility and applicability. Thus, and if the grinding or brushing operation does not result in a densification of the outermost stratum or strata of a thin panel, sheet or plate of metallic material (i.e., if the grinding or brushing operation is intentionally carried out with a view to avoid localized densification and hence the likelihood of cracking as a result of flexing, bevelling or an analogous deforming operation), the thin panel, sheet or plate is not likely to retain a layer of lacquer, paint or oxide if such sheet or plate is shaped (e.g., bent, bevelled or similarly treated) subsequent to application of the layer of lacquer or the like. The layer is likely to become separated from the brushed or ground surface of the panel, sheet or plate in the region of each bend or fold, and such separation affects its appearance, its useful life and/or other desirable characteristics.

U.S. Pat. No. 2,907,151 to Peterson discloses a method of conditioning metal strips, sheets and the like. The patented method includes cleaning the surface or surfaces of a metallic strip with rotary brushes, spreading an abrasive component into the region of contact between the strip and the brushes, and thereupon arcuately flexing the surface-roughened strip. The patentee also proposes to stretch the material of the strip prior to brushing. Such treatment is not acceptable for a number of applications and contributes significantly to the cost of the ultimate product. The surface of the strip normally undergoes pronounced densification as a result of treatment by the stretching rollers which are caused to apply pronounced pressure.

U.S. Pat. No. 3,082,517 to Holowaty proposes to spray abrasive material between two overlapping sheets one of which is coated with an adhesive material, and to thereupon apply pressure in order to embed the abrasive particles in the adjacent surfaces of the two strips.

British Pat. No. 495,421 to Daniels discloses a surface treatment which involves brushing or etching of metallic sheets or rolling of metallic sheets between specially prepared surfaces of rolls. The metallic blanks which are treated in accordance with the teaching of Daniels are smooth-surfaced soft sheets of aluminum or aluminum alloy. The sheets are debossed by pressing against their surfaces a perforated, woven or mesh-like metallic or textile material in sheet form. A drawback of the patented method is that one cannot avoid undesirable hardening of certain portions of the material along the treated surfaces.

U.S. Pat. No. 2,335,196 to Pecsok discloses a method of removing scale from metal sheets. The method includes spraying a hot sheet which issues from the mill with water, passing the sheet through breaker rolls to break the scale into particles, flexing the sheet over a roll to raise the edges of the particles of scale, and brushing off the scale.

Applicant is further aware of the disclosure in French Pat. No. 2,252,175 to Vsesojuzny Nauchnoissledovatelsky Institut, and of the article by W. K., Erickson entitled "Metal cleaning by microscalping" (Iron and Steel Engineer, Volume 54, No. 2, February 1977, pages 43–46).

OBJECTS OF THE INVENTION

An object of the invention is to provide a novel and improved method of roughening the surfaces of plates, sheets or panels which are made of metallic, plastic and/or other material.

Another object of the invention is to provide a method which renders it possible to roughen the surfaces of sheets, plates or panels without any, or without appreciable, hardening of the material of such blanks.

A further object of the invention is to provide a method which renders it possible to remove films of lubricant from metallic or plastic sheets, plates or panels in a simple and time-saving operation.

An additional object of the invention is to provide a novel and improved method of roughening all or selected portions of surfaces of sheets, plates or panels to a desired extent.

Still another object of the invention is to provide a method which renders it possible to ensure reliable application of layers of lacquer, paint and/or other coating materials to selected surfaces of sheets, panels or plates which are made of a metallic, plastic and/or other material.

A further object of the invention is to provide a novel and improved method of ensuring predictable oxidizing of surfaces of metallic plates, sheets, strips, panels or like blanks.

Another object of the invention is to provide a method which renders it possible to impart to one or both surfaces of a metallic or plastic sheet, panel, plate or a like blank any desired pattern of recesses which not only enhance the appearance of the finished product but also enhance its ability to accept and retain one or more layers or coats of paint or the like.

An additional object of the invention is to provide a novel and improved article of manufacture which is obtained in accordance with the above outlined method.

A further object of the invention is to provide a novel and improved sandwich which consists of a plurality of articles of manufacture at least one of which is surface-roughened in accordance with the above outlined method.

Still another object of the invention is to provide novel and improved apparatus for the practice of the above outlined method.

A further object of the invention is to provide a novel and improved tool for use in the above outlined apparatus.

SUMMARY OF THE INVENTION

One feature of the present invention resides in the provision of a method of mechanically beneficiating (particularly surface-toughening) one surface of a substantially sheet- or plate-like blank of metallic, plastic and/or other material. The improved method comprises a first step of providing the one surface of the blank with a plurality of grooves, and a second step of thereupon debossing the one surface including providing the one surface with a plurality of depressions.

The first step can comprise providing the one surface of the blank with a first set of grooves and with at least one second set of grooves which intersect the grooves of the first set. For example, the grooves of the at least one second set can cross the grooves of the first set at an angle of 90±45°.

The second step can comprise providing the one surface of the blank with substantially conical and/or with substantially pyramidal depressions. This can be achieved by contacting the one surface of the blank with a debossing tool having crossing neighboring rows and columns of substantially conical and/or pyramidal protuberances with apices at a spacing of 0.2–0.3 mm between the apices of protuberances in neighboring rows and at a spacing of 0.2–0.3 mm between the apices of protuberances in neighboring columns.

The depth of each depression can at least match the depth of a groove. Alternatively, the maximum depth of each depression can be less than or at most equals the average depth or the maximum depth of a groove.

The arrangement may be such that the second step comprises providing the one surface of the blank with a first series of successively applied rows of depressions and thereupon providing the one surface with at least one second series of successively applied rows of depressions which are staggered relative to the depressions of the first series in at least one of two directions, namely longitudinally and/or transversely of the rows.

In accordance with a presently preferred embodiment of the method, the second step comprises contacting the one surface of the blank with at least one rotary (e.g., cylindrical) debossing tool having a peripheral surface which is provided with an array of protuberances serving to form the depressions by penetrating into the one surface of the blank. Such second step can further include contacting the one surface with at least one additional rotary debossing tool having a peripheral surface provided with an array of protuberances offset with reference to the depressions which were formed by the protuberances of the at least one debossing tool.

If one disregards the exact nature of the debossing tool or tools, the second step of the method can be said to include contacting the one surface of the blank with a plurality of protuberances which are substantially complementary to the depressions and are caused to penetrate into the one surface to form the depressions therein. Such method can further comprise the step of varying (regulating) the extent of penetration of protuberances into the one surface to thereby vary or regulate the depth of the depressions.

The depressions can jointly cover at least the major part of the one surface of the blank. The blank and/or the debossing tool or tools can be heated prior to the second step.

The protuberances of the debossing tool or tools are preferably arrayed in a desired manner so as to ensure uniform or non-uniform distribution of depressions in the one surface when the second step is completed.

The method can comprise the additional step of providing the one surface of the treated blank (i.e., of the panel-, plate- or sheet-like body which constitutes a converted or beneficiated blank) with at least one layer of coating material subsequent to the second step. The additional step can comprise chemically treating (e.g., oxidizing) the one surface of the converted blank.

The first step can comprise brushing and/or grinding the one surface of the blank.

Another feature of the present invention resides in the provision of a novel article of manufacture which is a panel-, sheet- or plate-like body having a first surface and a second surface. One of these surfaces has at least one set of at least substantially parallel grooves and a plurality of depressions. The average depth of the grooves can match or exceed the maximum depth of the depressions. Alternatively, the maximum depth of the depressions can match or exceed the average or maximum depth of the grooves.

The depressions can form an array of intersecting neighboring parallel rows and parallel columns, and the deepmost portion of each (preferably conical, frustoconical, pyramidal or frustopyramidal) depression can be located at the intersection of one of the rows with one of the columns. The length 1 of each depression (as measured longitudinally of the columns) is preferably between 20 and 100 percent of the spacing of neighboring rows and/or neighboring columns, i.e., such spacing can be in the range of between 11 and 51.

The one surface of the panel-, plate- or sheet-like body can be provided with at least one second set of substantially parallel grooves which intersect the grooves of the at least one set at an angle of 90±45°. Each depression can communicate with a plurality of grooves.

A further feature of the invention resides in the provision of a novel article of manufacture which comprises a first panel-, sheet- or plate-like body having a first and a second surface, a second panel-, sheet- or plate-like body having a first surface adjacent the first surface of the first body and a second surface, and means for bonding the first surfaces to each other. Each of the first surfaces has at least one set of substantially parallel grooves and a plurality of depressions.

An additional feature of the invention resides in the provision of novel and improved apparatus and tool or tools for the practice of the above outlined method and for the making of the above outlined panel-, plate- or sheet-like bodies.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

BRIEF DESCRIPTION OF THE DRAWING

FIG. 5 is a perspective view of a portion of a blank and of a rotary debossing tool; and FIG. 6 is an enlarged fragmentary axial sectional view of the debossing tool and a fragmentary transverse sectional view of the blank.

DESCRIPTION OF PREFERRED EMBODIMENTS

Figure 1:
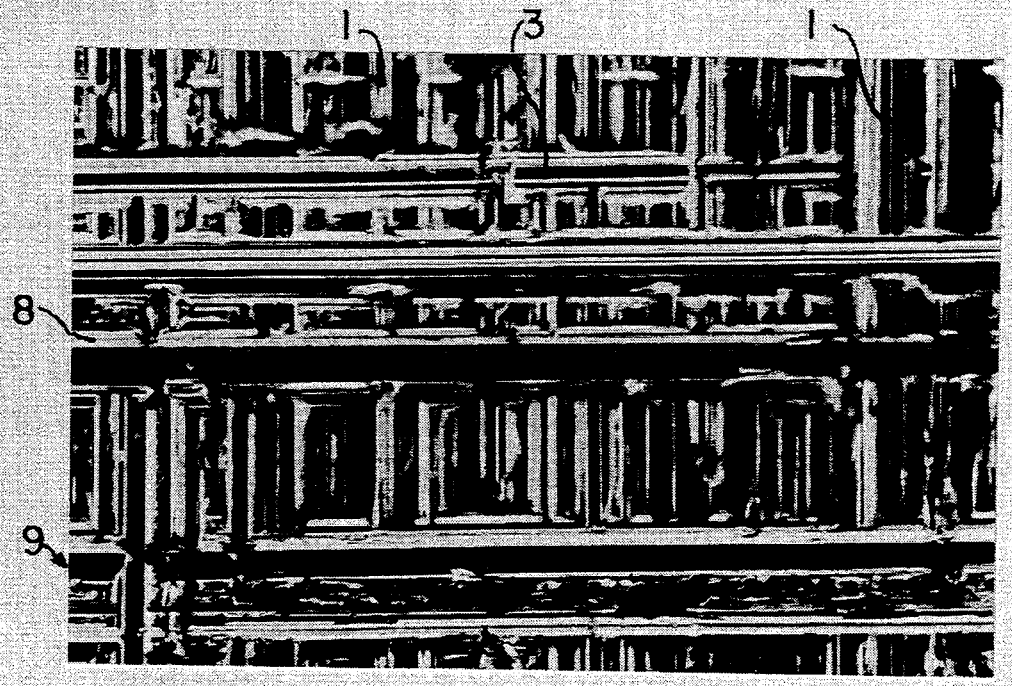
FIG. 1 is an enlarged photograph of one surface of a sheet-, plate- or panel-like blank which has been surface toughened in accordance with the first step of the improved method.

FIG. 1 is a 200 times enlarged view of a photograph of a portion of a plate-, panel- or sheet-like metallic or plastic blank 9 (hereinafter called blank for short). The illustrated side or surface 8 of the blank 9 has been subjected to the action of one or more brushes or grinding tools (e.g., one or more belts having exposed surfaces coated with an abrasive material). The brushing or grinding treatment resulted in the formation of two sets of grooves 1 and 3. The grooves 3 extend at right angles to and intersect or cross the grooves 1. The grinding or brushing of grooves 3 followed the making of the grooves 1. Depending on the nature of bristless of the brush or brushes, or on the particle size of abrasive material on the belt or belts of the grinding machine, the width of the grooves 1 and 3 can be 0.2 mm or less and the depth of each of these grooves can be 0.1 mm or less. The width of the grooves 1 need not be the same as that of the grooves 3; for example, the width of the grooves 3 can be greater if the particles of abrading material have undergone extensive wear during making of the grooves 1 or if a first grinding tool is used for the making of grooves 1 and a different second grinding tool is used for the making of grooves 3. Furthermore, the grooves 3 need not be exactly normal to the grooves 1; for example, the angle at which the grooves 3 intersect the grooves 1 can be anywhere between 90±45°.

Figure 2:
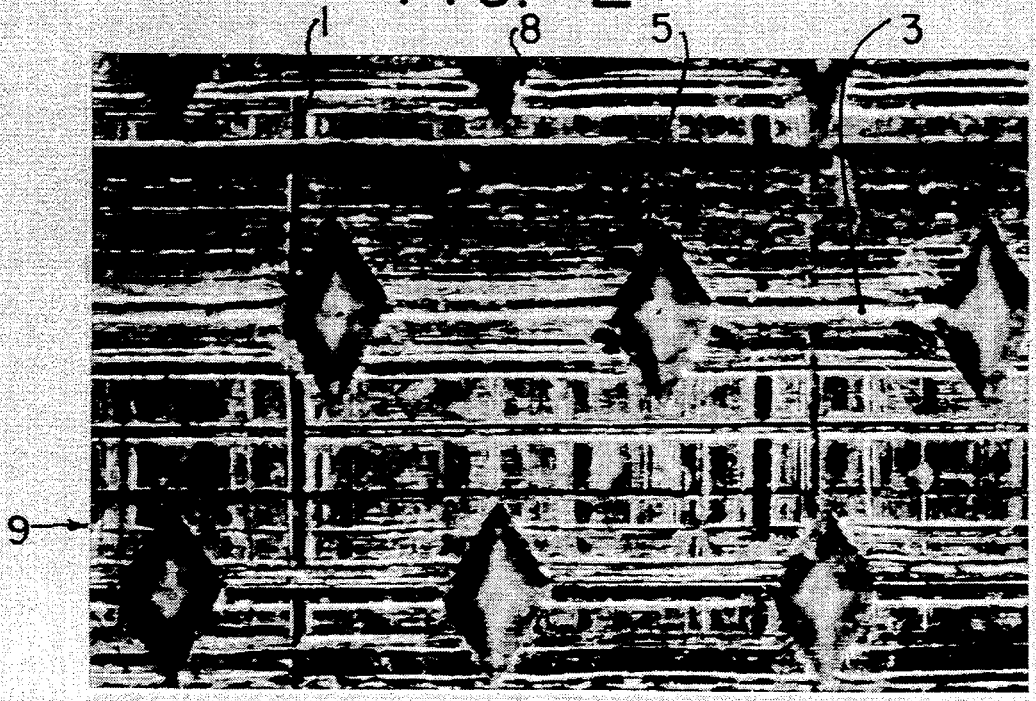
FIG. 2 is a similar enlarged photograph of the blank of FIG. 1 subsequent to completion of the debossing step.

FIG. 2 shows that the side or surface 8 which has been formed with the intersecting grooves 1, 3 of FIG. 1 is further formed with an array of substantially rhomboidal or diamond-shaped depressions 5. These depressions were formed by the complementary protuberances 11 at the periphery of a rotary debossing tool 7 which is shown in FIGS. 5 and 6. The depressions 5 are elongated in the direction of the grooves 3. In order to provide the surface 8 of the blank 9 with an array of depressions 5 of the type shown in FIG. 2, it is necessary to treat the blank twice, i.e., in two successive stages, because the protuberances 11 of the tool 7 of FIG. 5 form neighboring axially parallel rows and neighboring circumferentially extending columns disposed at right angles to the rows. The rows of protuberances 11 form successive rows A1, A2, A3, A4, . . . of depressions 5, and the columns of protuberances 11 form a series of longitudinally extending columns B1 to B7 on that surface (8) of the blank 9 which is already provided with intersecting grooves 1 and 3. The first stage of the second (debossing) step resulted in the making of the upper or lower row of depressions 5 which are shown in FIG. 2, and the second stage of the debossing step resulted in the making of the lower or upper row of depressions 5 of FIG. 2. The depressions of the lower row are staggered or offset relative to the depressions of the upper row in the longitudinal and transverse directions of the blank 9. The blank 9 of FIG. 5 can move in or counter to the direction which is indicated by arrow F, and the debossing tool 7 can be caused to rotate in or counter to the direction of arrow W.

The illustrated protuberances 11 are four-sided pyramids. However, it is equally within the purview or the invention to employ a debossing tool with peripheral protuberances in the form of truncated pyramids, cones, truncated cones or similar figures.

The depth (h-f) of depressions 5 can be varied by varying the distance of the surface 8 from the peripheral surface of the tool 7 and/or vice versa. The arrangement is or can be such that the dimensions of all depressions 5 in the surface 8 of the blank 9 are the same. The appearance of the surface 8 of the blank 9 is determined primarily by the depressions 5, and these depressions can be applied in such numbers and in such sizes that they cover at least the major part of the surface 8. Since the illustrated depressions 5 form a regular array, they impart to the surface 8 an eye-pleasing regular configuration.

If the blank 9 is a relatively thin sheet of metallic material, the maximum depth of depressions 5 can match or can be slightly less than the average or median depth of the grooves 1 and/or 3. If the blank 9 is a relatively thick sheet, plate or panel, the maximum depth of depressions 5 can equal or exceed the average or median depth of the grooves 1 and/or 3. The depth of depressions 5 which are shown in FIG. 2 exceeds the standard depth of such depressions in finished plate-, panel- or sheet-like bodies; the depth has been exaggerated for the sake of clarity.

If the depressions 5 are to cover the major part of the surface 8, the blank 9 of FIG. 2 can be treated seriatim by two or more different debossing tools 7 or repeatedly by one and the same debossing tool. The exact distribution of depressions 5 in the raster which is provided in the finished surface 8 can be selected practically at will, not only as concerns the overall number of depressions but also regarding their shape, their mutual spacing and that percentage of the surface 8 which is covered by depressions.

It is further clear that, if the surface 8 is to be treated by two or more debossing tools, the configuration of protuberances 11 on one of the tools need not be identical with the configuration of protuberances on the other tool or tools. The same holds true for the dimensions and the distribution of protuberances on two or more discrete debossing tools.

Figure 3:
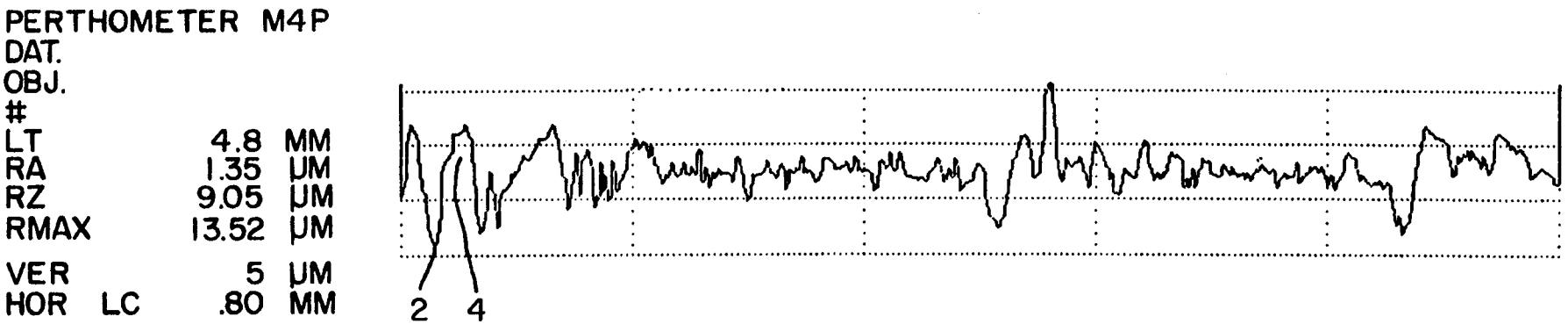
FIG. 3 is a surface roughness diagram of the blank which is shown in FIG. 1.

FIG. 3 shows a surface roughness diagram which has been obtained with an instrument known as Perthometer M4P (produced and distributed by Feinpruf GmbH Feinmess- und Prufgerate, Gottingen, Federal Republic Germany) upon completion of the first method step, i.e., upon completed making of the grooves 1 and 3. The diagram exhibits a number of intersecting hills 2 and valleys 4 which developed as a result of the making of two sets of intersecting grooves 1 and 3.

Figure 4:
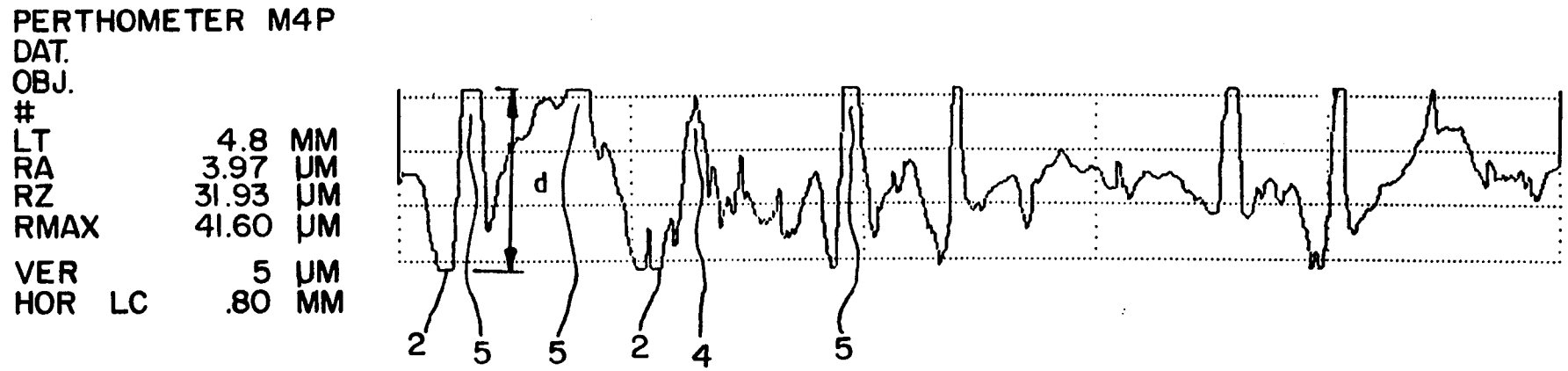
FIG. 4 is a similar surface roughness diagram of the blank subsequent to the debossing step.

The diagram of FIG. 4 is representative of roughness of the surface 8 subsequent to completion of the second (debossing) step, i.e., subsequent to the making of depressions 5. The character d denotes the (variable or regulatable) depth of the depressions 5, and such depth can be achieved without unduly or appreciably hardening the corresponding portions of the material of the blank 9. FIG. 4 further shows that the debossing step resulted in elimination of very shallow (minute) hills and valleys which are observable in the surface roughness diagram of FIG. 3. The elimination of such shallow hills and valleys is of no consequence because these valleys are too small to receive particles or droplets of coating material (e.g., lacquer) which is or which can be applied to the treated surface 8. In other words, and if the coating material were lacquer, paint or another moisture-containing substance, such substance could not moisturize the surfaces flanking the minute valleys which are shown in the diagram of FIG. 3 but are at least partially eliminated in the course of the debossing step.

The making of depressions 5 entails a pronounced enlargement of the overall area of the surface 8 because the height of the hills 2 and the depth of the valleys 4 are very pronounced. This, in turn, ensures much more satisfactory adherence of coating material to the surface 8 in the course of the next-following additional step of applying one or more layers of lacquer, paint or the like. The same holds true for an artificially produced oxide layer which can be obtained by exposing the grooved and debossed surface 8 to atmospheric air or to the action of an oxidizing agent in a vessel or the like, not shown. The width of the valleys 4 is or can be selected in such a way that the valleys permit penetration of coating material or oxidizing agent in the course of the additional step which follows the debossing step with one or more tools of the type shown in FIG. 5 and/or with other types of tools.

The treatment of surface 8 in the aforedescribed manner (namely the making of grooves 1 and/or 3 prior to the making of depressions 5) excludes the development of undesirable cavities.

The letters LT denote in FIGS. 3 and 4 the measuring range of the Perthometer, the letters RA denote the calculated average or median surface roughness or peak-to-valley height, the letters RZ denote the calculated lower limit or lower threshold of average or median value of the surface roughness, and the letters RMAX denote the upper limit or upper threshold of average or median value of the surface roughness.

Referring again to FIG. 5 and to FIG. 6, the character a denotes the mutual spacing of neighboring rows of protuberances 11 at the periphery of the debossing tool 7, and the character t denotes the mutual spacing of neighboring columns of protuberances 11. The spacing a can approximate or match the spacing t and can be in the range of 0.2 to 0.4 mm, e.g., approximately 0.3 mm. The apex of each protuberance 11 is preferably located at the intersection of the respective axially parallel row of protuberances on the tool 7 with one of the columns which extend circumferentially of the tool. As already mentioned above, the surface 8 of the blank 9 can be treated by one and the same debossing tool in two or more successive stages or by two or more different debossing tools during two or more successive stages of the second (debossing) step. The extent of penetration of protuberances on successive tools or during successive stages of the use of one and the same tool need not be the same. In other words, the surface 8 can be provided with two or more arrays of depressions 5 having different sizes, shapes and/or depths. If one and the same tool is used to carry out two or more successive stages of the debossing step, the positions of the tool and surface 8 relative to each other are changed prior to each next-following stage of the debossing step (see FIG. 2) in order to ensure a predictable and optimum distribution of identical or different depressions 5 in the finished surface 8. The arrangement may be such that the making of a second series of depressions entails displacement of the material of the blank into the previously formed depressions and/or into the grooves 1 and/or 3. In other words, the making of a second or third series of depressions 5 can result in partial or even very pronounced deformation of previously formed depressions and/or in partial or pronounced deformation of some of the parallel grooves 1 and/or some of the parallel grooves 3.

As also mentioned above, the maximum depth of depressions 5 can approximate or exceed or be less than the average or median depth of the grooves 1 and/or 3, depending upon the thickness of the blank 9 and upon certain other considerations (such as the desired enlargement of the area of the surface 8 as a result of the making of grooves 1 and/or 3 and of subsequent making of depressions 5, the material of the blank 9, the initial roughness of the surface 8, the thickness of the film (if any) of lubricant on the surface 8 prior to the surface beneficiating treatment and/or the nature of additional treatment (e.g., coating or oxidizing) that is to follow the making of depressions 5).

If the protuberances 11 are truncated cones or truncated pyramids, each depression 5 includes a bottom portion adjacent a small flat surface of the blank 9. Non-truncated pyramids or non-truncated cones can become truncated as a result of repeated use. Alternatively, the maker of the debossing tool 7 can intentionally provide the latter with protuberances in the form of truncated cones or pyramids in order to reduce wear upon the apices of the protuberances. The flat surfaces at the bottoms of depressions 5 which are shown in FIG. 2 can be seen only because of pronounced magnification (at least 100 times) of the illustrated portion of the surface 8.

The blank 9 of FIGS. 5 and 6 is made of a metallic material. However, it is equally within the purview of the invention to increase the surface roughness of plastic plates, panels or sheets. For example, one surface of a plastic sheet, plate or panel can be provided with grooves 1 and/or 3 and thereupon with depressions 5 prior to coating of the thus treated surface with a layer of metallic material. Alternatively, the treated surface 8 of the blank 9 can be bonded to the similarly treated or untreated surface of a second blank by resorting to a suitable adhesive. The tool 7 and/or the blank 9 can be heated during treatment of the surface 8 with protuberances 11 if such heating facilitates controlled penetration of protuberances into the surface 8 and/or entails a less pronounced wear upon the protuberances.

As a rule, the grooves 1 and/or 3 will be formed by resorting to a grinding tool, e.g., one or more endless belts which are coated with granules of suitable abrasive material. Brushes will be used to make the grooves 1 and/or 3 if the surface 8 need not be treated with a very high or with a maximum degree of precision.

If the blank 9 of FIGS. 5 and 6 is to be bonded or plated to a second treated or untreated blank, the resulting sandwich exhibits highly desirable properties such as pronounced resistance to undesirable flexing or bending, a desired thickness as well as longer useful life. A plastic plate-, sheet- or panel-like body can be bonded to a metallic body, two plastic bodies can be bonded to each other, or a first metallic body can be bonded to a second metallic body. It is equally possible to make a sandwich consisting of more than two metallic and/or plastic panels, plates or sheets at least one of which has been surface beneficiated in accordance with the improved method.

The protuberances 11 of FIGS. 5 and 6 can form integral parts of the cylindrical main portion Z of the debossing tool 7. Alternatively, and as shown in FIG. 6, the protuberances 11 can form part of a jacket or tube *7a* which is mounted on the main portion Z of the debossing tool 7. The jacket or tube *7a* can be removed from the main portion Z of the debossing tool 7 when the protuberances 11 on the jacket have undergone a certain amount of wear. Thus, it is not necessary to dispose of the entire tool when the protuberances are no longer capable of forming depressions 5 of desired size and/or shape. This can entail substantial savings in maintenance cost of the apparatus which employs the improved debossing tool. The jacket or tube *7a* can be formed by bonding or otherwise securing a sheet with protuberances at one of its sides to the peripheral surface of main portion Z of the tool 7 of FIG. 5. The jacket *7a* can be made of relatively thin metallic sheet material or the like.

An important advantage of the improved method is that the debossing step which follows the groove-forming step greatly enhances the ability of the treated surface to accept and retain layers of paint, lacquer, adhesive and/or other substances. Moreover, the combined brushing or grinding and debossing treatment does not result in undesirable densification and hardening of certain portions of treated blanks, not even if the blanks are thin sheets of metallic or plastic material. Therefore, a sheet which has been treated in accordance with the improved method is much less likely to undergo denting, buckling and/or other types of deformation than similar sheets which are treated in accordance with conventional methods.

The debossing tool changes the shape of hills or ridges which develop between the grooves, namely, the protuberances 11 render the hills or ridges less pronounced and therefore more receptive to coating with lacquer or the like without the formation of holes in the applied layer, especially in the region of sharp edges of the ridges, which would give rise to corrosion and would shorten the useful life of the coated sheet-, plate- or panel-like body. The protuberances 11 (which act upon the surface 8 subsequent to formation of the grooves 1 and/or 3) do not press the adjacent material deeper into the blank 9 but rather into the adjacent grooves and/or into the adjacent depressions (which were formed during a preceding stage of treatment with the debossing tool) so that the material of the blank is much less likely to undergo localized densification and hardening than the blanks which are treated in accordance with heretofore known methods and in heretofore known apparatus.

Grinding of the surface 8 (for the purpose of providing the grooves 1 and/or 3) normally entails some melting of the material of hills between the grooves and at least slight or even pronounced smoothing of the surfaces bounding the hills. The debossing step generates forces which act to shift the material of the blank 9 in substantial parallelism with the surface 8 so that the thus displaced material causes a toughening of the surfaces which bound the hills between the grooves 1 and 3 (i.e., the displaced material causes a roughening of the flanks of the hills). This results in the formation of relatively narrow cracks or crevices which permit penetration of coating material or oxidizing liquid with attendant superior coating of the surface 8 by a layer of lacquer or the like or by an oxide layer.

The overall area of the surface 8 can be increased practically at will by the simple expedient of selecting the size and/or shape and/or density of the depressions 5 in the finished sheet-, plate- or panel-like body. The area of the surface 8 will be increased if some material of the blank 9 which is displaced during treatment with a second or third debossing tool or during a second, third, etc. treatment with one and the same tool is caused to penetrate into the previously formed depressions.

Each depression 5 can communicate with a substantial number of grooves 1 and/or 3. Thus, the making of depressions 5 does not result in elimination of the grooves 1 and/or 3. Otherwise stated, surface roughening which is brought about by the brushing or grinding instrumentality or instrumentalities remains at least substantially intact and is compounded by surface-roughening which is achieved as a result of treatment with one or more debossing tools.

A further important advantage of the improved method is that the configuration and/or distribution of depressions 5 can be readily selected with a view to enhance the appearance of the treated surface 8. It is presently preferred to employ one or more debossing tools which are provided with pyramidal protuberances.

An additional important advantage of the improved method and of the plate-, panel- or sheet-like bodies which are obtained as a result of the aforediscussed treatment of blanks is that neither the first nor the second step of the method involves a treatment which would be objectionable for ecological or similar reasons, i.e., it is not necessary to employ chemicals which cannot be simply released into the atmosphere, into the ground or into water. Moreover, the treatment does not entail the development of harmful substances which would have to be confined, gathered and disposed of with substantial expenditures in time, money and equipment and by endangering the environment and the attendants.

Another advantage of the improved method is its simplicity. The blanks are subjected to simple mechanical treatment by resorting in part to available machines and in part to relatively simple debossing apparatus.

EXAMPLE

The blank 9 was made of a oxygen-free roofing or coating copper sheet stock with a thickness of 0.7 mm. The first step involved the making of grooves 1 and 3 in the surface 8 by means of a belt-shaped grinding tool type 1920, SIARAL F produced by SIA AG, Frauenfeld, Switzerland. The belts contained a substrate of linen and a coating of corundum paper with a grain size 80. The abrasive surface of the grinding belt was caused to apply to the copper blank a pressure of approximately 0.7 bar and was moved relative to the blank at a speed of 30 meters per second. A first pass resulted in the making of grooves 1 and the next-following pass resulted in the making of grooves 3. The surface 8 of the blank 9 was devoid of ungrooved portions upon completion of the second pass.

The twice grooved blank 9 was thereupon advanced in the direction of arrow F while its surface 8 was being debossed by the protuberances 11 of the freely rotatable tool 7. The cylindrical main portion Z of the tool 7 had a diameter D=42 mm and the peripheral surface of the main portion Z was provided with pyramidal protuberances 11. The spacing t of neighboring circumferentially extending columns of protuberances was 0.3 mm and the spacing a of neighboring axially parallel rows of protuberances was also 0.03 mm.

The edges L bounding the bases of the protuberances 11 constituted or resembled the sides of rhombi R which were elongated in the circumferential direction of the main portion Z. The angle beta between a pair of mutually inclined sides of each rhombus R was an acute angle (60°).

The distance h (FIG. 6) of the apex of each protuberance 11 from the peripheral surface of the main portion Z was 0.03 mm, and the apex angle alpha (FIG. 6) of each protuberance 11 was 90°. The distance f (FIG. 6) of the surface 8 from the peripheral surface of the main portion Z of the tool 7 was 0.1 mm. The blank 9 was stationary and the tool 7 was moved in the direction of arrow F while rotating in the direction of arrow W. The speed of movement of the tool 7 in the direction of arrow F was 10 meters per minute and the shaft of the tool was urged toward the surface 8 (to maintain the distance f=0.1 mm) with a force P=135 N/mm. This resulted in penetration of portions of protuberances 11 into the surface 8 and in the formation of substantially rhomboidal depressions 5. The depth of each depression was 0.2 mm, each depression had a rhomboidal outline Rb, each depression had a length 1 of 0.03 mm and each depression had a width q of 0.2 mm (as measured in and transversely of the direction indicated by arrow F (i.e., in the longitudinal direction of the elongated blank 9).

The protuberances 11 penetrated primarily into the surfaces bounding the grooves 1, 3 rather than into those portions of the surface 8 which were not affected by the grinding tool. Such penetration of protuberances 11 generated shifting forces which interrupted the relatively smooth surfaces developed as a result of partial melting during treatment with the grinding tool, i.e., the flanks of the hills 2 shown in FIG. 4 were interrupted and the surfaces surrounding the depressions 5 exhibited microscopic gaps with a width in the range of one-hundredth of one millimeter or a few hundredths of one millimeter.

The first treatment of the surface 8 with the tool 7 was followed by second treatment with the same tool. However, the position of the toll 7 relative to the blank 9 (and/or vice versa) was changed so that the circumferentially extending columns of protuberances 11 were located midway between the columns B1 to B7 and the axially parallel rows of protuberances 11 were located midway between the rows A1, A2, A3, A4 and the next-following rows. In other words, the two series of depressions 5 were arrayed in so-called quncunx formation and the depressions of the second series were sufficiently close to the depressions of the first series to enable the protuberances to shift some material of the blank 9 into the depressions of the first series. Thus, the area of each surface surrounding a depression of the first series was enlarged in order to further enhance the ability of the surface 8 to accept and retain a coat of lacquer, paint, adhesive or the like.

The spacing a and/or the spacing t can be between 11 and 51.

It has been found that, when the surface 8 of the thus treated blank 8 (i.e., of the plate-, panel- or sheet-like body) was coated with a layer of lacquer, adherence of the layer to the surface 8 was much more satisfactory than adherence of the same type of lacquer to a surface which was treated in accordance with earlier surface roughening proposals. The layer of lacquer on the roughened surface 8 was capable of standing much higher mechanical stresses and was also more resistant to the corrosive action of air and other fluids. The resistance of the layer of lacquer was more satisfactory indoors as well as outdoors.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of mechanically surface-roughening one surface of a panel-, sheet- or plate-like blank, comprising a first step of mechanically forming the one surface with a plurality of grooves; and a second step of thereupon debossing the one surface, including mechanically forming said surface with a plurality of depressions.

2. The method of claim 1, wherein said first step includes forming the one surface with a first set of grooves and with at least one second set of grooves which intersect the grooves of said first set.

3. The method of claim 2, wherein the grooves of said at least one second set cross the grooves of said first set at an angle of 90°±45°.

4. The method of claim 1, wherein said second step comprises forming the one surface with substantially conical depressions.

5. The method of claim 1, wherein said second step comprises forming the one surface with substantially pyramidal depressions.

6. The method of claim 1, wherein said second step comprises contacting the one surface with a debossing tool having crossing neighboring rows and columns of protuberances with apices at a spacing of 0.2–0.3 mm between the apices of protuberances in neighboring rows and a spacing of 0.2–0.3 mm between the apices of protuberances in neighboring columns.

7. The method of claim 1, wherein each of said grooves has a first depth and each of said depressions has a second depth which at least matches said first depth.

8. The method of claim 1, wherein said second step includes forming the one surface with a first series of successively applied rows of depressions and thereupon forming the one surface with at least one second series of successively applied rows of depressions which are staggered relative to the depressions of the first series in at least one of two directions including longitudinally and transversely of the rows.

9. The method of claim 1, wherein said second step includes contacting the one surface with at least one rotary debossing tool having a peripheral surface provided with an array of protuberances.

10. The method of claim 9, wherein said second step further includes contacting the one surface with at least one additional rotary debossing tool having a peripheral surface provided with an array of protuberances offset with reference to the depressions which are formed by the protuberances of the at least one debossing tool.

11. The method of claim 1, wherein said second step includes contacting the one surface with a plurality of protuberances which are substantially complementary to the depressions and which penetrate into the one surface to form the depressions, and further comprising the step of varying the extent of penetration of the protuberances to thereby vary the depth of depressions.

12. The method of claim 1, wherein said depressions jointly cover at least the major part of the one surface.

13. The method of claim 1, further comprising the step of heating the blank prior to said second step.

14. The method of claim 1, wherein said second step comprises contacting the one surface with at least one heated debossing tool having a peripheral surface provided with an array of protuberances.

15. The method of claim 1, wherein said second step comprises contacting the one surface with at least one predetermined array of protuberances.

16. The method of claim 1, further comprising an additional step of applying to the one surface at least one layer of coating material subsequent to said second step.

17. The method of claim 1, further comprising an additional step of chemically treating the one surface.

18. The method of claim 1, wherein said first step comprises grinding the one surface.

19. The method of claim 1, wherein said first step comprises brushing the one surface.

20. The method of claim 1, wherein said blank is made of metal.

21. The method of claim 1, wherein said blank is made of plastic material.

* * * * *